United States Patent [19]

Sassmannshausen

[11] Patent Number: 4,559,589

[45] Date of Patent: Dec. 17, 1985

[54] LIGHTING FIXTURE WITH A CONCAVE REFLECTOR, SUCH AS A TAIL, WARNING OR SIGNAL LIGHT ETC.

[76] Inventor: Knut O. Sassmannshausen, 5 Pinewood Estate, Wexford, Ireland

[21] Appl. No.: 533,611

[22] Filed: Sep. 16, 1983

Related U.S. Application Data

[63] Continuation of Ser. No. 121,022, Feb. 13, 1980, abandoned.

[51] Int. Cl.[4] ..... F21V 7/00

[52] U.S. Cl. ..... 362/305; 362/64; 362/72; 362/307; 362/309; 362/310; 362/311; 362/328; 362/329; 362/333; 362/332; 362/337; 362/338; 362/346; 362/347; 362/350; 362/368

[58] Field of Search ..... 362/307, 309, 311, 332, 362/333, 368

[56] References Cited

U.S. PATENT DOCUMENTS

| | | | |
|---|---|---|---|
| 1,676,464 | 7/1928 | Ryan | 362/336 X |
| 1,764,474 | 6/1930 | Shippee | 362/61 X |
| 1,964,325 | 6/1934 | Lebby | 362/336 X |
| 1,992,041 | 2/1935 | Roper et al. | 362/350 X |
| 2,006,249 | 6/1935 | Rall | 362/61 |
| 2,041,315 | 5/1936 | Barclay | 362/83 X |
| 2,058,707 | 10/1936 | McGregor | 362/335 |
| 2,062,993 | 12/1936 | Haines | 362/83 X |
| 2,216,965 | 10/1940 | Sukumlyn | 362/335 X |
| 2,224,178 | 12/1940 | Bitner | 362/337 |
| 2,245,755 | 6/1941 | Carpenter | 362/83 |
| 2,254,961 | 9/1941 | Harris | 362/336 X |
| 2,279,103 | 4/1942 | Anklam | 362/61 X |
| 2,352,801 | 7/1944 | Ralph | 362/337 X |
| 3,110,883 | 11/1963 | Nallinger et al. | 362/64 X |
| 3,184,592 | 5/1965 | Gibie | 362/346 X |
| 4,115,843 | 9/1978 | Nagel | 362/337 X |
| 4,213,171 | 7/1980 | Sassmannshausen | 362/336 X |
| 4,261,027 | 4/1981 | Chapman et al. | 362/309 X |

*Primary Examiner*—Peter A. Nelson

*Attorney, Agent, or Firm*—Herbert L. Lerner; Laurence A. Greenberg

[57] ABSTRACT

Lighting fixture including an enclosure, means disposed in the enclosure for supplying a central source of light therein, a concave, generally parabolic reflector for directing a main beam of light out of the enclosure from the source generally along a given optical axis, the central source of light being located at the focal region of the concave reflector, the concave reflector having a light penetrable region thereof disposed at least at one side of the optical axis in a horizontal plane in common with the central light source, the light-penetrable region forming an escape window out of the enclosure for part of the light from the source.

11 Claims, 20 Drawing Figures

FIG. 1
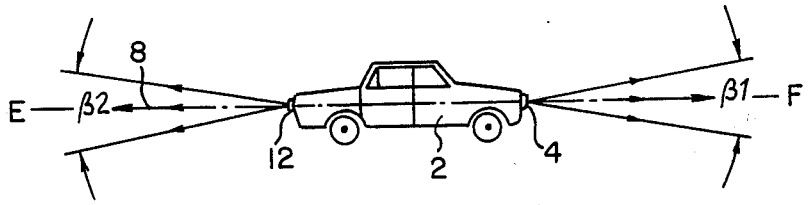
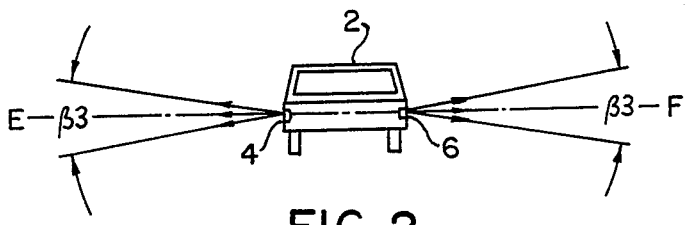
FIG. 2
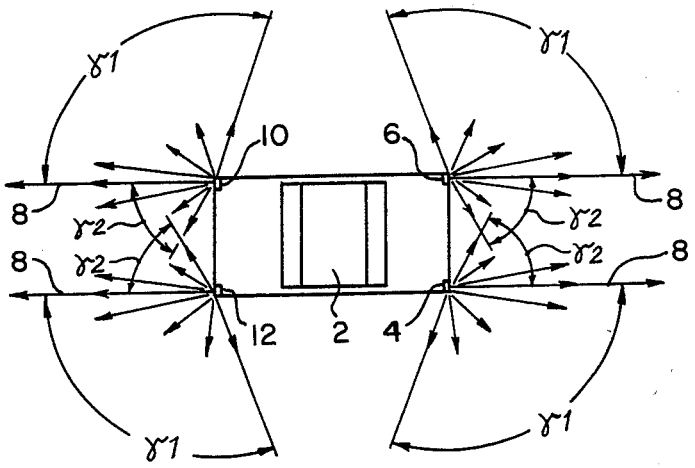
FIG. 3

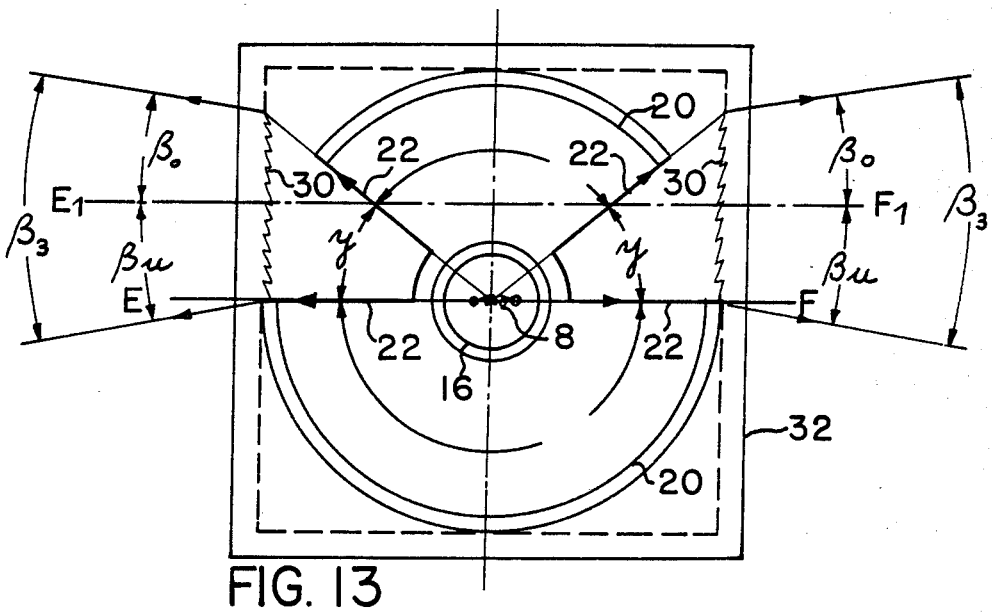
FIG. 13
FIG. 14
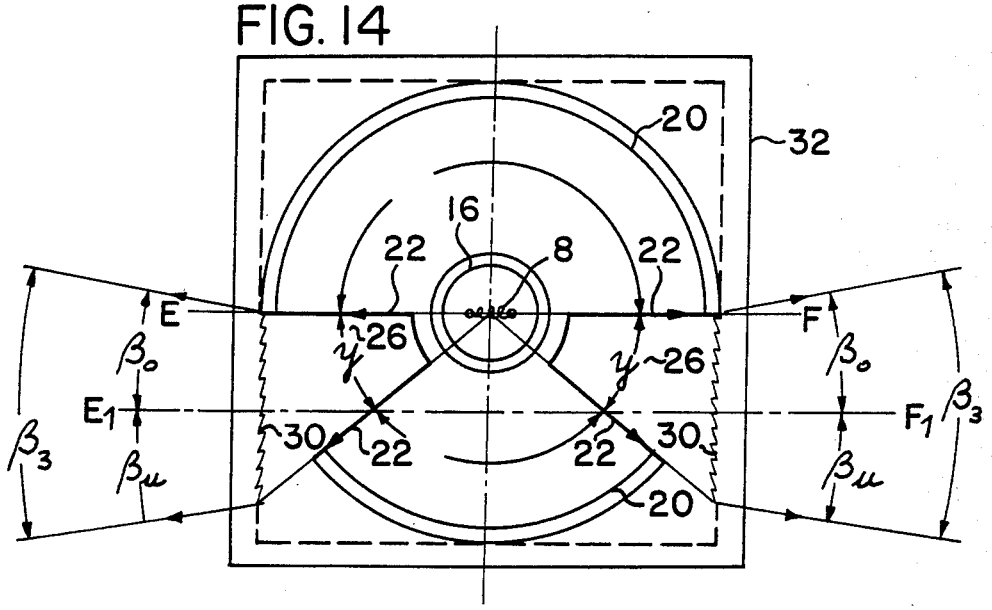

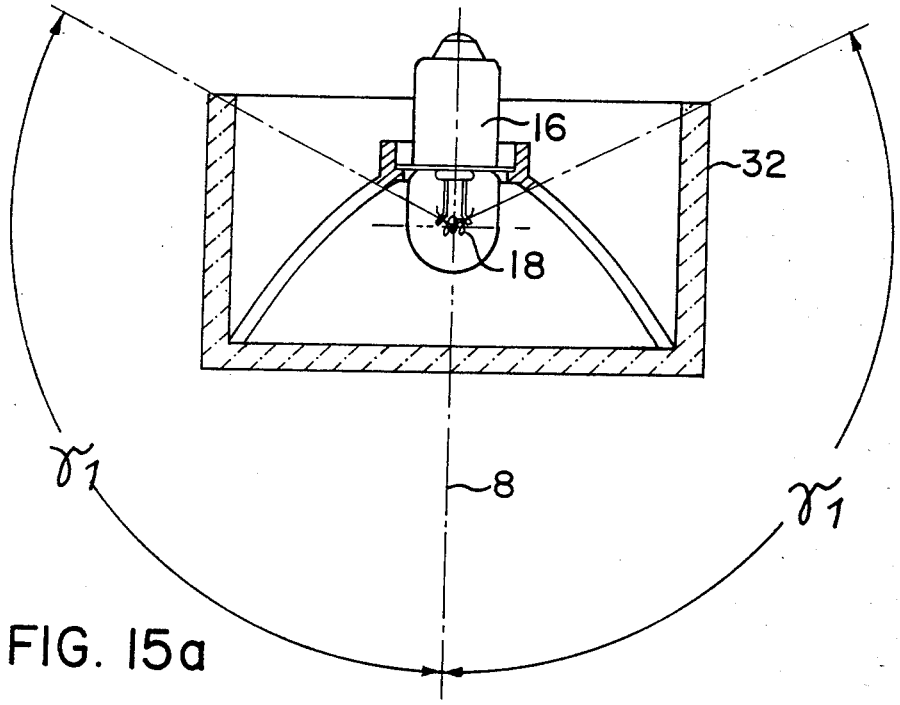
FIG. 15a
FIG. 15
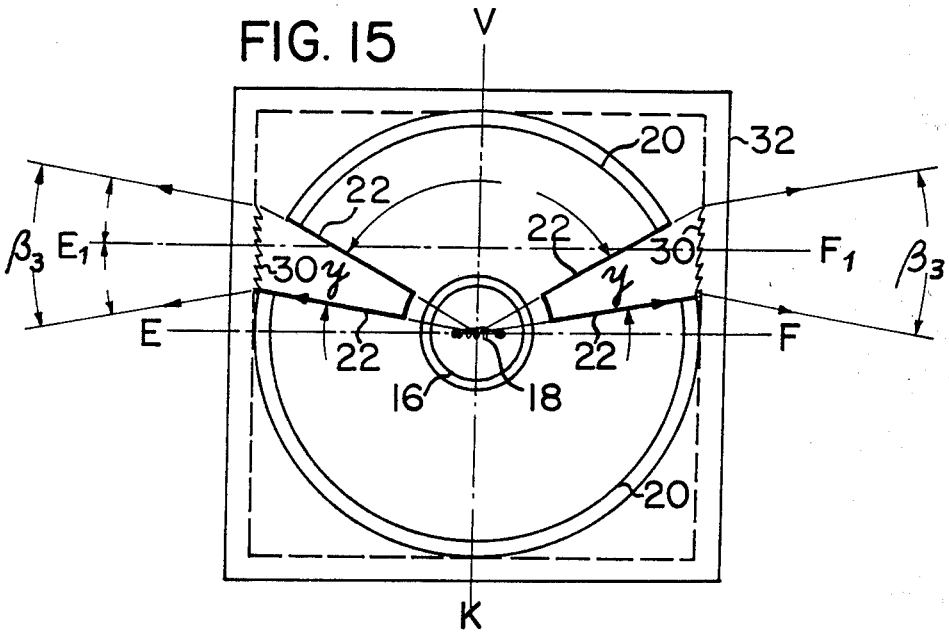

FIG. 17
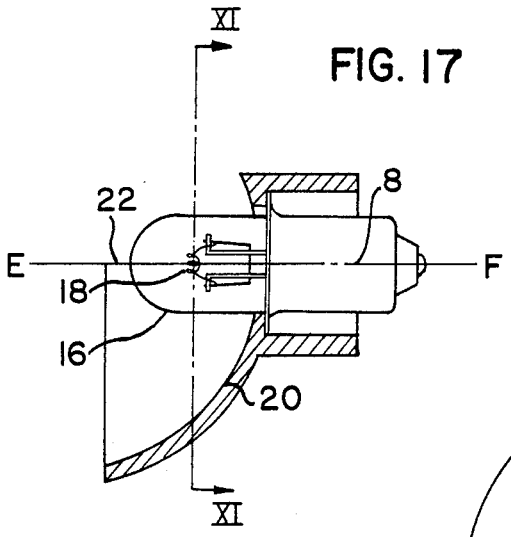
FIG. 17a
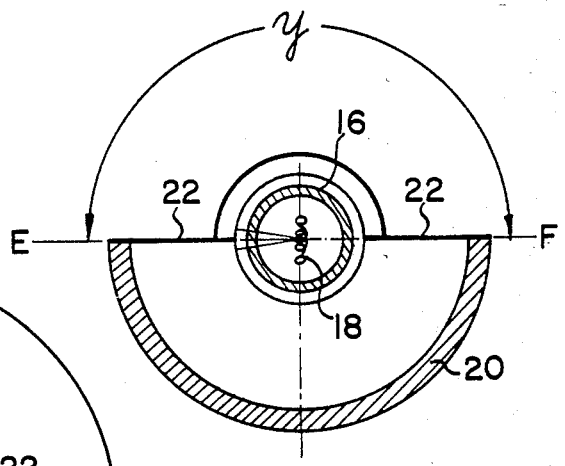
FIG. 17b
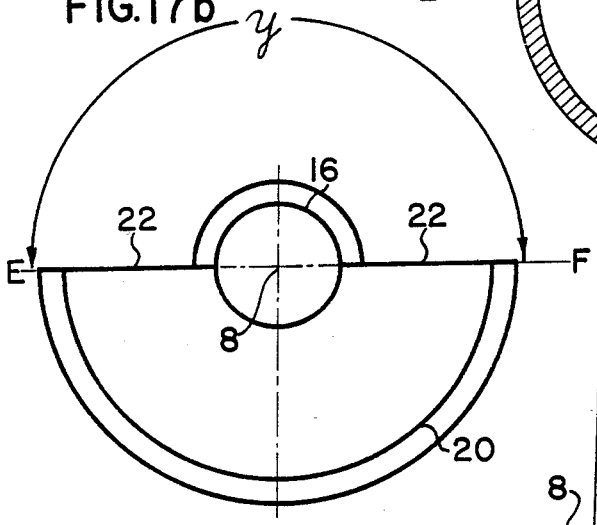
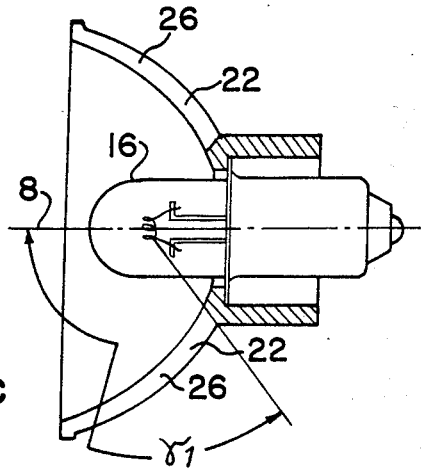
FIG. 17c

LIGHTING FIXTURE WITH A CONCAVE REFLECTOR, SUCH AS A TAIL, WARNING OR SIGNAL LIGHT ETC.

This application is a continuation of application Ser. No. 121,022 filed Feb. 13, 1980, now abandoned.

The invention relates to a lighting fixture, and more particularly to a tail, warning or signal light or headlight for vehicles e.g. motor vehicles such as automobiles, trucks or motorcycles or the like as well as non-motorized vehicles such as bicycles. What is meant by a "signal light", for example, is a blinking light, a parking light or a stop light.

A main light beam of the lighting fixture should include, for example, a solid angle having a square cross section which extends, when mounted on a vehicle, in the direction of travel or opposite thereto, (a) in a horizontal plane including the optical axis of a concave reflector of the lighting fixture over an angular range of 20° (range of ±10° on both sides of the optical axis), and (b) in a vertical plane which includes the optical axis of the concave reflector of the lighting fixture and is perpendicular to the horizontal plane mentioned under (a) above, over an angular range of 20° (range of ±10° on both sides of the optical axis).

The main light beam should have a brightness that is as high as possible, so that the light can be seen from a great distance. In sharp curves or to traffic at the sides thereof, this main light beam is not visible, however. For this purpose, a second zone of light radiation is needed with an angular range having upward and downward limits of, for example, about 20° in the vertical plane.

It is accordingly an object of the invention to provide a lighting fixture with a concave reflector which with simple means, provides at least a second light radiation zone which is fanned out as widely as possible i.e. to provide one or two additional light beams which are emitted in a lateral direction in the horizontal plane.

This linking or association of the horizontal plane of the lateral light fan to the location of the light source often sets narrow limits on the technical construction or design of such lighting fixtures, especially for multi-chamber lighting fixtures wherein several signal lights are disposed above one another.

It is another object of the invention to provide such a lighting fixture with a concave reflector which will also radiate light and, indeed, advantageously with reduced light intensity, beyond the officially prescribed light radiating zone of ±10° upwardly and downwardly of the horizontal plane.

The necessity therefor is briefly explained by the following example: A bicyclist must stop because of opposing traffic at a busy intersection i.e. an intersection subject to heavy traffic, when making a left turn. Since the bicycle is then at a standstill, the bicyclist must often dismount and stand at the side of the bicycle. It often occurs in such a case that the bicycle is not held exactly vertically but rather at a slight inclination, such as 6°, for example, to the bicyclist. A consequence thereof is that the lateral radiation of a tail light increases by only about 4° instead of about 10° for a bicycle in a vertical position. If a heavy tractor-trailer, for example, were to approach this intersection from this side, and the driver thereof is seated so high up that his eyes are 2.5 meters above the roadway, the bicycle lighting would then disappear for him, the instant he has approached to about 25 meters from the bicycle. If glaring or dazzling opposing traffic is also present in such a case, a quite serious accident could result.

On the other hand, the driver of the tractor trailer has approached so close to the bicyclist that, in the range under discussion, namely of 25 meters distance to the bicycle, quite limited light intensities are sufficient to ensure further visibility of the bicycle lighting i.e. light should likewise not be radiated, in accordance with the invention, into a range or zone deviating by more than 10° from the horizontal, advantageously with reduced light intensities.

With the foregoing and other objects in view, there is provided, in accordance with the invention, a lighting fixture comprising an enclosure, means disposed in the enclosure for supplying a central source of light therein, a concave, generally parabolic reflector for directing a main beam of light out of the enclosure from the source generally along a given optical axis, the central source of light being located at the focal region of the concave reflector, the concave reflector having a light penetrable region thereof disposed at least at one side of the optical axis in a horizontal plane in common with the central light source the light-penetrable region forming an escape window out of the enclosure for part of the light from the source.

In accordance with another feature of the invention the light-penetrable region comprises at least one aperture formed in the concave reflector.

In accordance with a further feature of the invention, the concave reflector has light-penetrable regions on both sides of the optical axis.

In accordance with an added feature of the invention, the concave reflector has a base at one end thereof and a light outlet at the other end thereof, the light-penetrable region being in the form of a slot extending from a region adjacent the base toward the outlet.

In accordance with an additional feature of the invention, the concave reflector is formed of a base translucent material having a covering of reflective mirroring material, the ligh-penetratable region being at a portion of a concave reflector at which the covering of reflective mirroring material is omitted from the base translucent material.

In accordance with yet another feature of the invention, the means for supplying the central source of light comprise a luminous body, and including a collecting lens disposed in front of the luminous body and an optical system in front of the collecting lens for scattering light in only two opposing directions in the horizontal plane.

In accordance with yet a further feature of the invention, the light-scattering optical system comprises a concave cylindrical lens.

In accordance with yet an added feature of the invention, the enclosure has a cover plate, and the concave cylindrical lens is an integral part of the cover plate.

In accordance with yet an additional feature of the invention, the concave reflector has a base at one end thereof and a light outlet at the other end thereof, the light penetrable region being in the form of a slot extending from a region close to the base to the light outlet, the means for supplying a central light source comprising a luminous body, and there is provided an optical collecting system disposed in a light path extending from the luminous body and through the slot.

In accordance with still another feature of the invention, the optical collecting system is disposed between the luminous body and the slot.

In accordance with still a further feature of the invention, the optical collecting system is disposed outside the reflector and in front of the slot.

In accordance with still an additional feature of the invention, the optical collecting system comprises a cylindrical collecting lens disposed in the horizontal plane.

In accordance with another feature of the invention, the cylindrical collecting lens is disposed in the horizontal plane at one side of the optical axis, and another cylindrical collecting lens is disposed in the horizontal plane at an opposite side of the optical axis from the first-mentioned cylindrical collecting lens.

In accordance with a further feature of the invention, the cylindrical collecting lens is a multistep cylindrical collecting lens.

In accordance with an added feature of the invention, both of the cylindrical collecting lenses are elongated and mutually joined in front of the luminous body into one continuous lens member extending over areas which are at best only slightly irradiated by the main light beam.

In accordance with an additional feature of the invention, the means for supplying a central light source comprise a luminous body, and there is provided an optical scattering system disposed in a light path extending from the luminous body through the aperture.

In accordance with yet another feature of the invention, the optical scattering system is disposed between the luminous body and the aperture.

In accordance with yet a further feature of the invention, the optical scattering system is disposed in the aperture.

In accordance with yet an added feature of the invention, the optical scattering system is disposed outside the reflector and in front of the aperture.

In accordance with yet an additional feature of the invention, the optical scattering system comprises a cylindrical dispersing lens disposed in the horizontal plane.

In accordance with still another feature of the invention, the concave reflector forms part of the enclosure.

In accordance with still a further feature of the invention, the enclosure is sealed in the form of a sealed-beam lighting fixture.

In accordance with still an added feature of the invention, the aperture is formed as a slot in the concave reflector on only one side of the optical axis in the horizontal plane, and there is provided a spherical reflector extending over an annular region and disposed between the central light source and the concave reflector on the other side of the optical axis and opposite the slot whereby part of the light radiated directly from the light center and impinging on the spherical reflector is, in turn radiated therefrom through the slot.

In accordance with still an additional feature of the invention, the spherical reflector is of multistep construction.

In accordance with again another feature of the invention, the spherical reflector is disposed in a region of the concave reflector.

In accordance with again a further feature of the invention, there is provided a lighting fixture assembly of a lighting fixture and a second lighting fixture combined therewith into a structural unit, the second lighting fixture having a concave reflector located at least nearly beyond the concave reflector of the first-mentioned lighting fixture, the second lighting fixture having an optical axis disposed at an angle of between 2° to 6° to the optical axis of the first-mentioned lighting fixture, the optical axis of the first-mentioned lighting fixture, in installed condition of the lighting fixture assembly, being disposed in the horizontal plane, both of the lighting fixtures having respective incandescent lamps as the means for supplying a light source, the incandescent lamp of the first-mentioned lighting fixture having a smaller current drain than that of the second lighting fixture and serving as a position light, the incandescent lamp of the second lighting fixture having the optical axis thereof declining from the horizontal plane in the installed condition of the lighting fixture assembly and serving for illumination.

In accordance with again an added feature of the invention, there is provided a common housing for both of the lighting fixtures, and a spirit level mounted on the common housing.

In accordance with again an additional feature of the invention, there are provided means connectible to a battery for energizing the first-mentioned lighting fixture with battery current, and means selectively connectible to a battery and to a mechanical generator for energizing the second lighting fixture.

In accordance with another feature of the invention, there is provided a lighting fixture comprising an enclosure, means disposed in the enclosure for supplying a central source of light therein, a concave reflector for directing a main beam of light out of the enclosure from the source generally along a given optical axis, the concave reflector having a light-penetrable region thereof disposed at least at one side of the optical axis generally outside a horizontal plane in common with the central light source and forming an escape window out of the enclosure for part of the light from the source, and means for directing the part of the light into at least one horizontal plane adjacent thereto.

In accordance with an added feature of the invention, the concave reflector is generally parabolic, and the central light souce is at the focal region of the generally parabolic reflector, the means for directing said part of said light comprising prisms.

In accordance with an additional feature of the invention, there is provided a lighting fixture with a concave reflector having a main beam outlet and an additional lateral light outlet aperture on one side of the optical axis thereof so that light rays directly emanating from a luminous body are partly collected by the concave reflector into a main light beam reflected through the main beam outlet and partly radiated away through the additional lateral light outlet aperture, the lateral light outlet aperture being disposed nearly outside a horizontal plane in common with the light center of the luminous body, comprising light-conducting means disposed in the light path through the lateral light outlet aperture for deflecting in substantially horizontal directions at least part of the light rays passing laterally out of the concave reflector, the substantially horizontal directions being substantially perpendicular to the axis of the concave reflector.

One or more additional light fans are thus produced toward the side, which advantageously exhibit the largest possible aperture angle in the horizontal. On the other hand, the aperture angles in vertical directions are limited by the remaining parts of the concave reflector.

In accordance with yet another feature of the invention, the lateral light outlet aperture extends from one side of a horizontal plane extending through the luminous body to the opposite side thereof, the lateral light outlet aperture extending over an angle of about 180° perpendicularly to the axis of the concave reflector.

In accordance with yet a further feature of the invention, the lateral light outlet aperture extends from one side of a horizontal plane extending through the luminous body to the opposite side thereof, the lateral light outlet aperture extending over an angle smaller than 180° perpendicularly to the axis of the concave reflector.

In accordance with yet an added feature of the invention, the lateral light outlet aperture, at least on one side of the concave reflector, extends from a region located in vicinity of a horizontal plane extending through the luminous body over an angular zone of at least 20° perpendicularly to the axis of the concave reflector.

The last-mentioned feature is desirable for removing the smallest amount of light from the light beam collected by the concave reflector.

In accordance with yet an additional feature of the invention, the lateral light outlet aperture, at least on one side of the concave reflector, extends from a region located in vicinity of a horizontal plane extending through the luminous body over a first angular zone of more than 20°, and the light-conducting means disposed in the light path through the lateral light outlet aperture serve not only for deflecting the light rays in substantially horizontal directions but also for collecting the light rays in a second angular zone, the second angular zone having a smaller aperture angle than that of the first angular zone.

In accordance with still another feature of the invention, a respective lateral light outlet aperture is disposed to the right-hand and left-hand sides of a plane extending perpendicularly to the axis of the concave reflector.

In accordance with still a further feature of the invention, the light-conducting means have means for deflecting in substantially horizontal directions within a given angular zone only part of the light rays impinging thereon, another part of the light rays being able to be radiated in a region beyond the given angular zone.

In accordance with still an added feature of the invention, the light-conducting means comprise a plurality of prisms.

In accordance with still an additional feature of the invention, the part of the light rays impinging on the deflecting means of the light-conducting means is more than 50% of the light rays, and the other part of the light rays is less than 50% of the light rays. In this way, assurance is provided that, for example, 10° above and 10° below a horizontal plane as much light as possible is radiated so as to be able to warn traffic approaching from the side at great distances. If such side traffic has approached to shorter distances, however, the eyes of the driver, under certain conditions or circumstances, are then located no longer in the light-radiation range or zone of 10° above and 10° below the horizontal plane. Then, those light rays which emerge beyond these given angular ranges, take over the function of maintaining the visibility of the lighting fixture with an approach to a distance of nearly zero. Since this must function only for short distances, the light intensities may, in this case be considerably smaller.

In accordance with yet another feature of the invention, there is provided an additional, upwardly directed light outlet aperture disposed in the upper part of the concave reflector and optical means disposed in the radiation path of the upwardly emerging light for enlarging at least one of the aperture angles thereof.

In accordance with yet a further object of the invention, the lateral light outlet aperture constitutes a slot in the concave reflector extending from an edge thereof at the greatest diameter thereof to a base in vicinity of a receptacle for the luminous body.

In accordance with yet an added feature of the invention, the light center of the luminous body defines, with opposing points of edges of the lateral light outlet aperture, an aperture angle remaining substantially constant along the slot.

In accordance with yet an additional feature of the invention, the means for directing the part of the light into at least one horizontal plane adjacent thereto are V-shaped reflecting wedges.

In accordance with again another feature of the invention, the concave reflector forms part of the enclosure.

In accordance with a concomitant feature of the invention, an additional light penetrable region is located in an upper part of the concave reflector, and there are provided optical dispersing means disposed in a path of the light radiating upwardly through the additional light-penetrable region.

Other features which are considered as characteristic for the invention are set forth in the appended claims.

Although the invention is illustrated and described herein as embodied in a lighting fixture with a concave reflector, such as a tail, warning or signal light or headlight, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIGS. 1 to 3 are side, rear elevational and top plan views, respectively, of a motor vehicle showing diagrammatically the disposition of lighting fixtures thereon in accordance with the invention;

Figure 10:
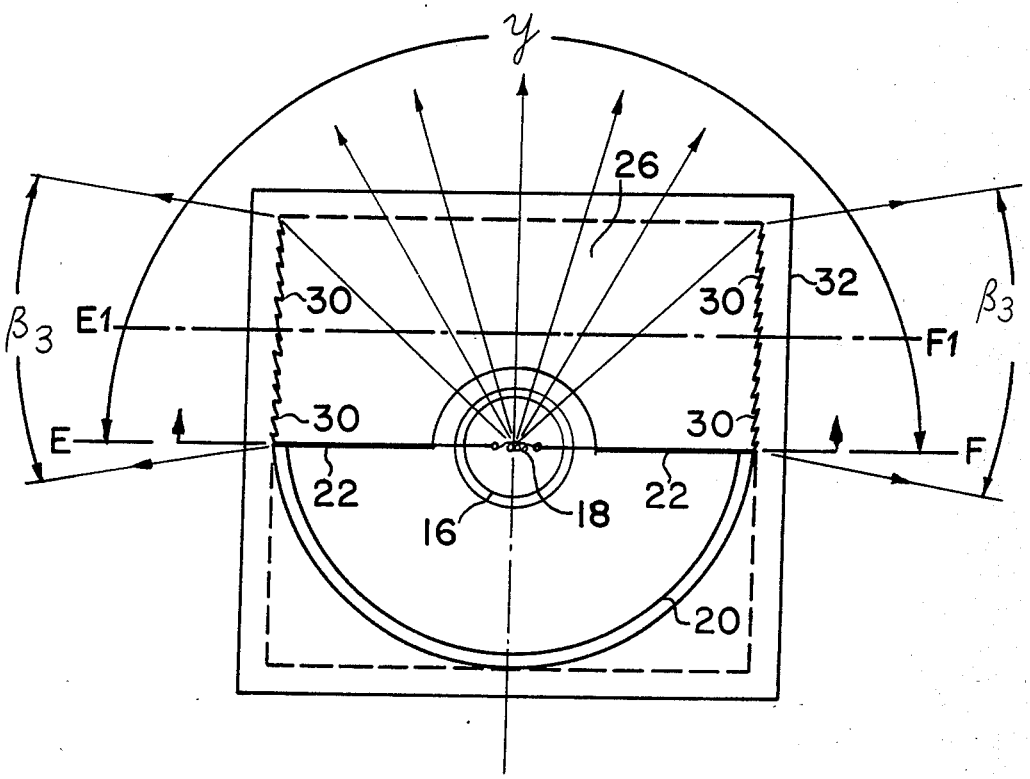
Figure 10A:
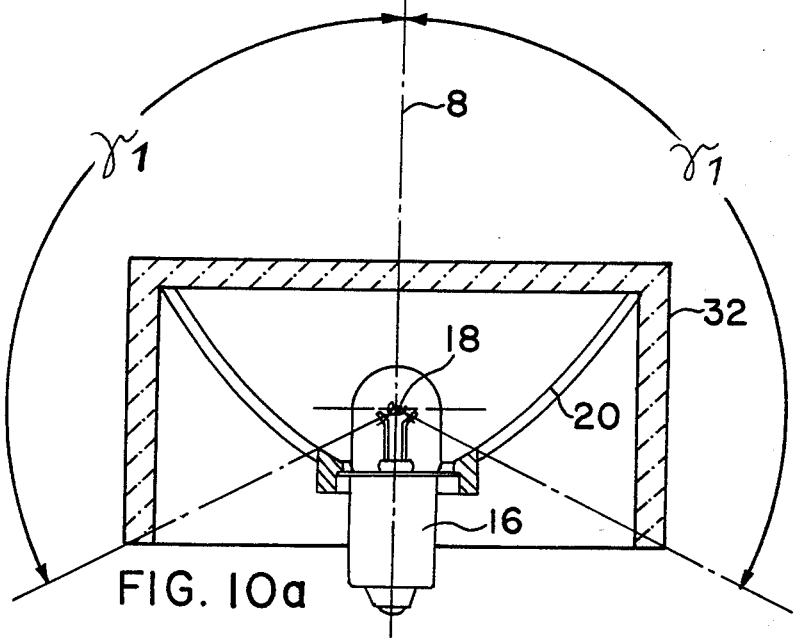
Figure 11:
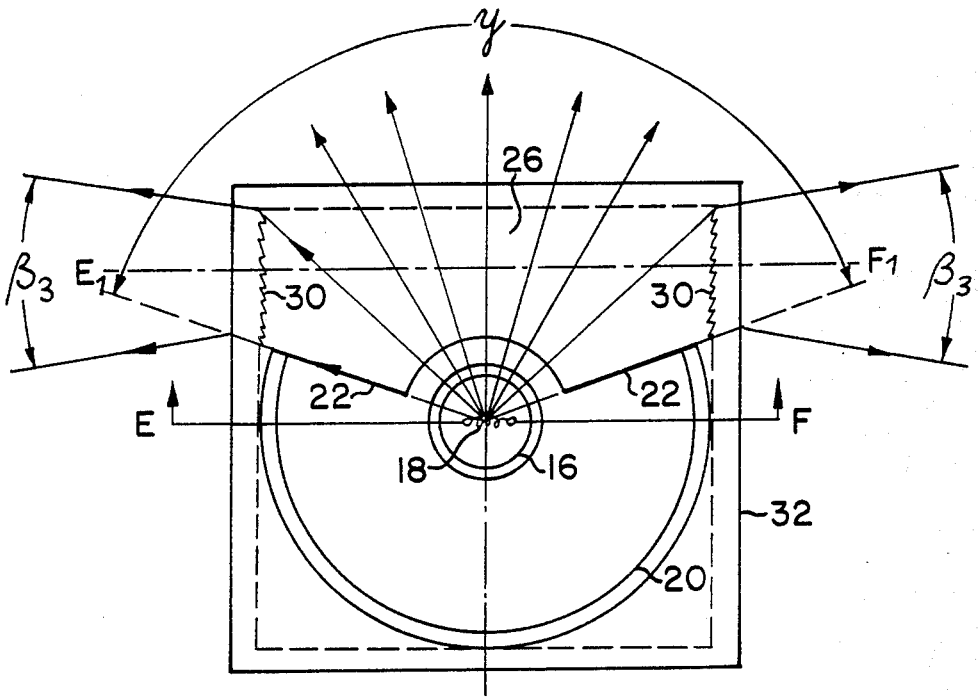
Figure 11A:
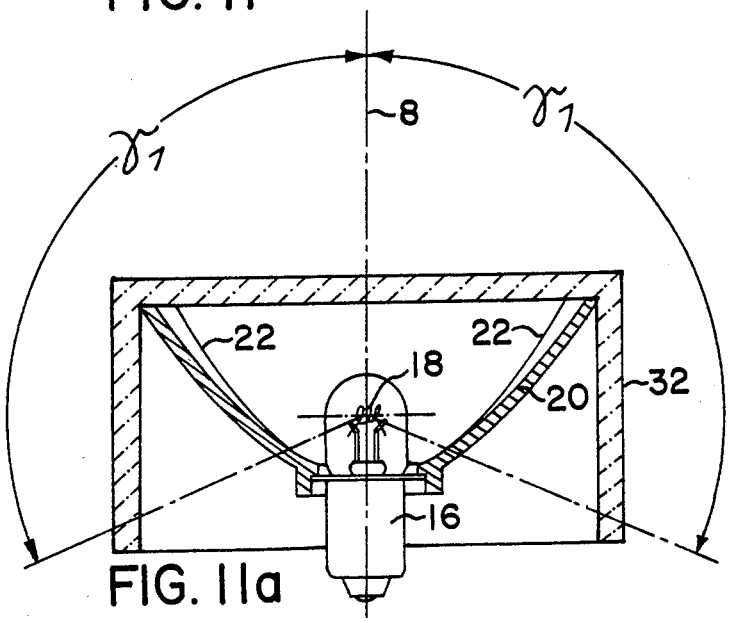
Figure 12:
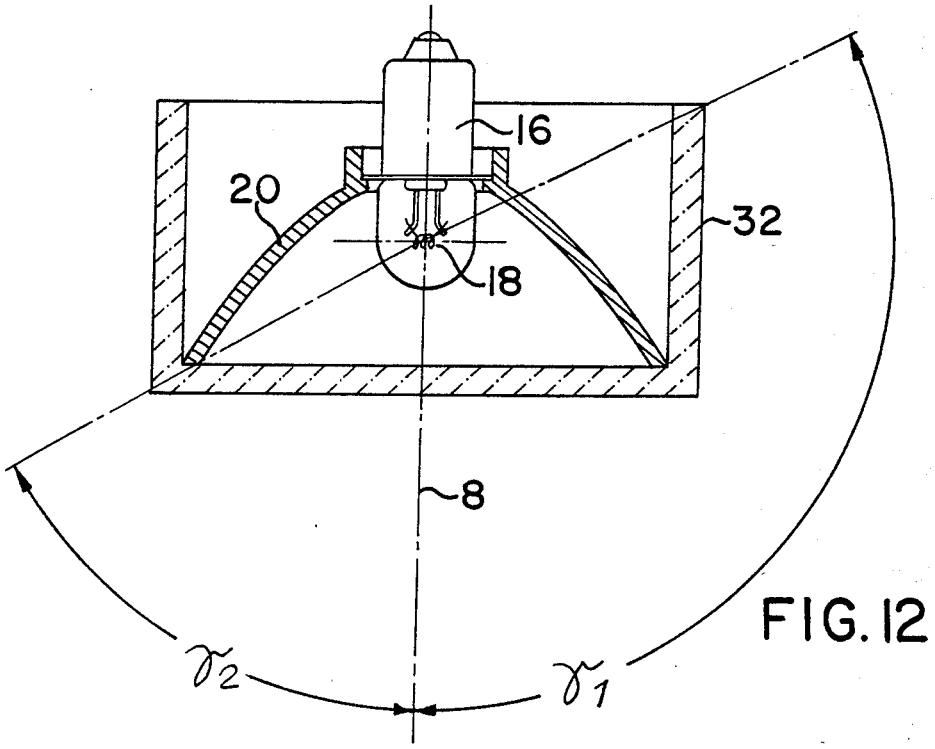
Figure 12A:
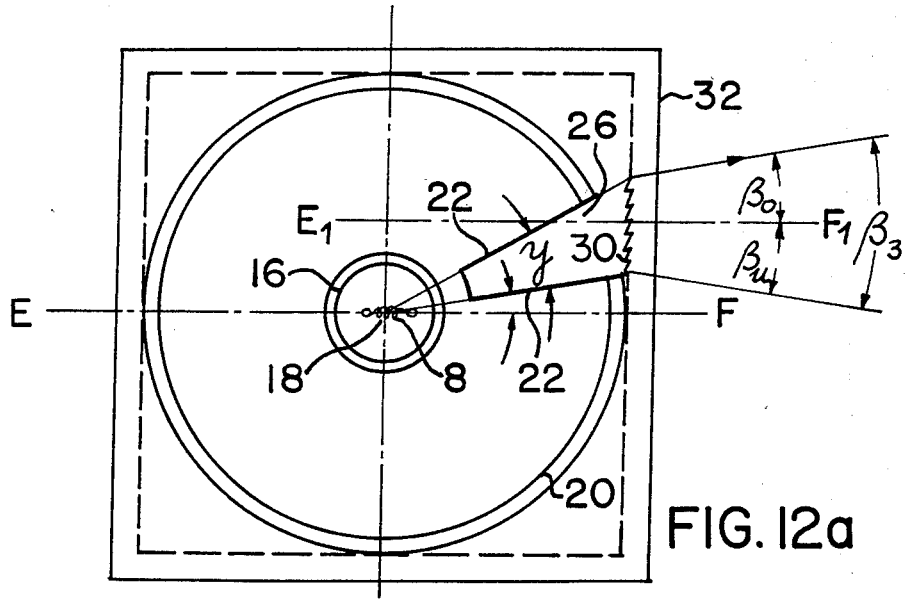
Figure 12B:
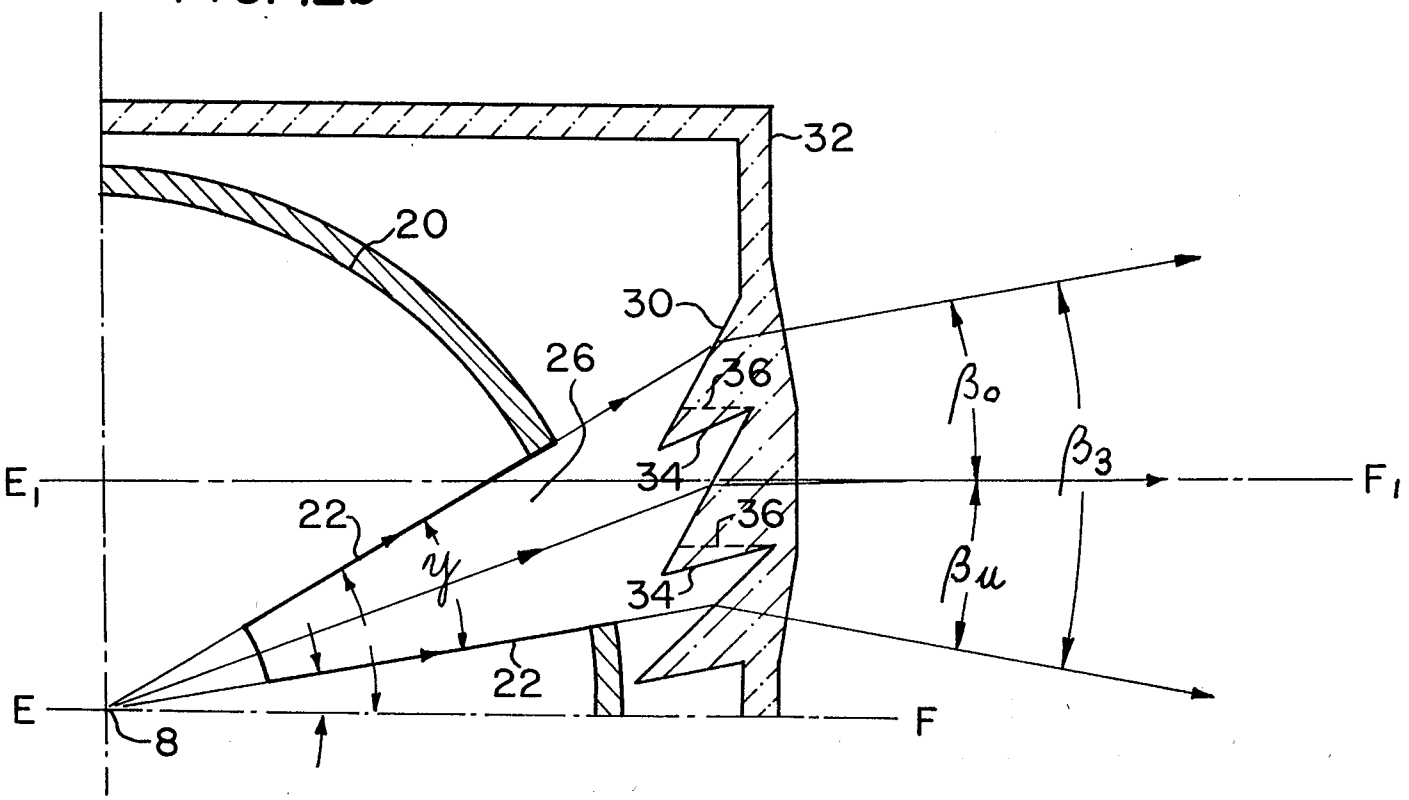
Figure 13A:
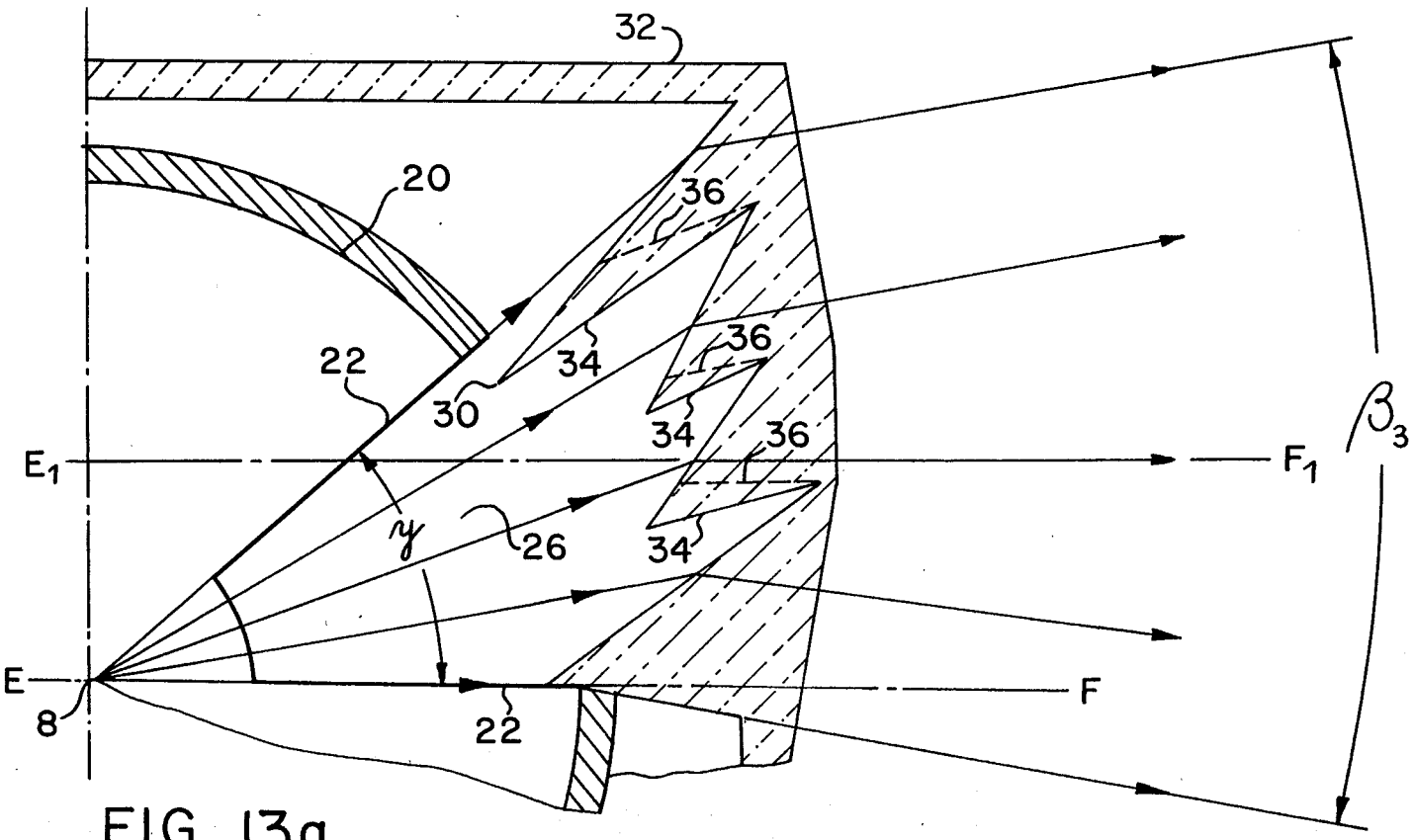
Figure 16A:
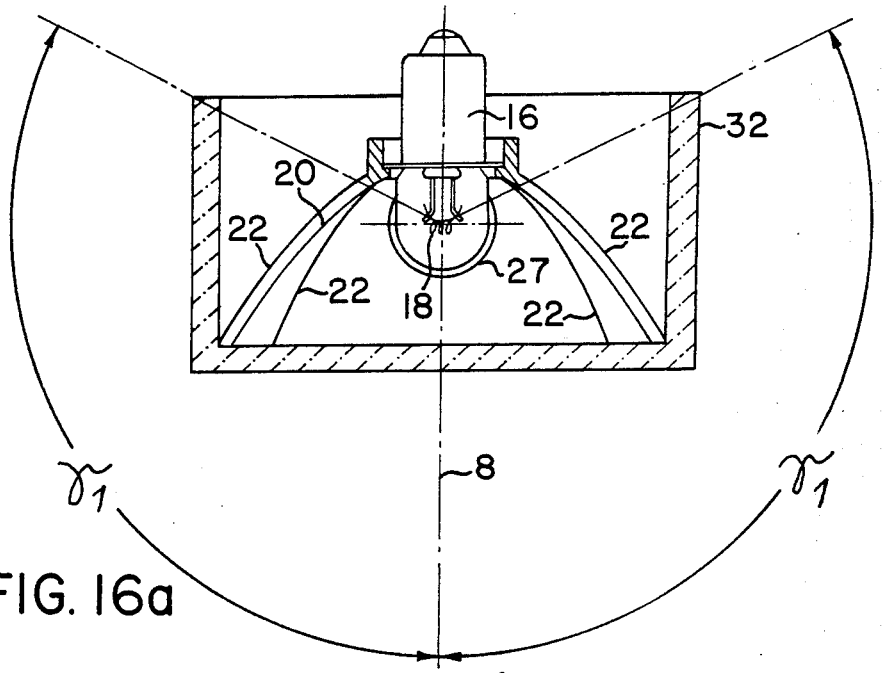
Figure 16:
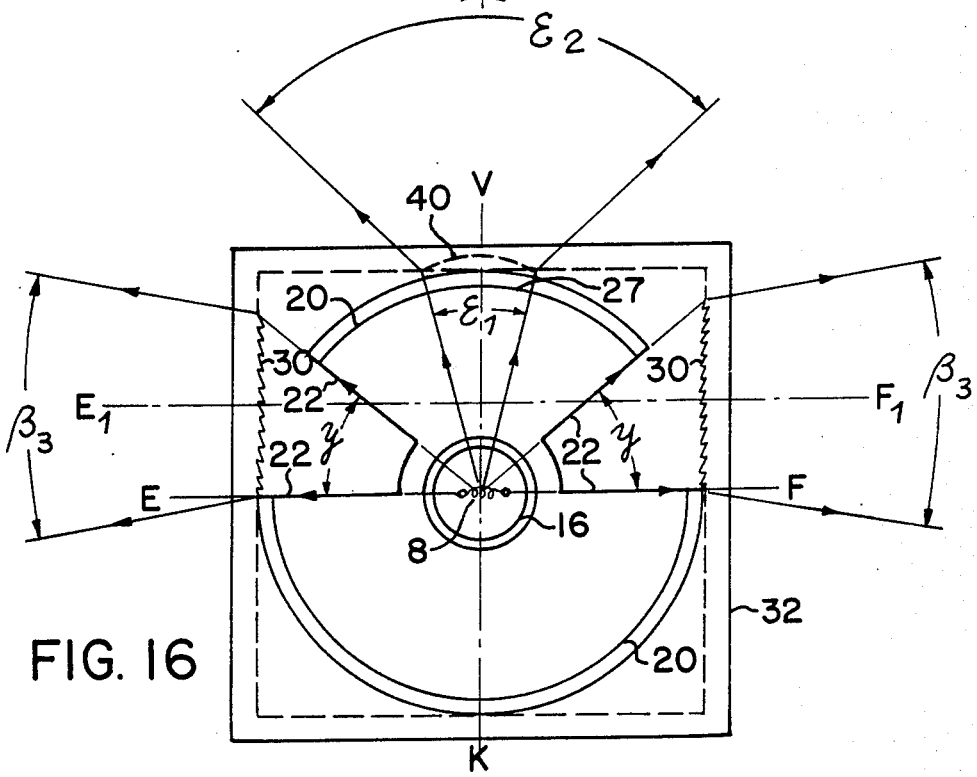
Figure 19:
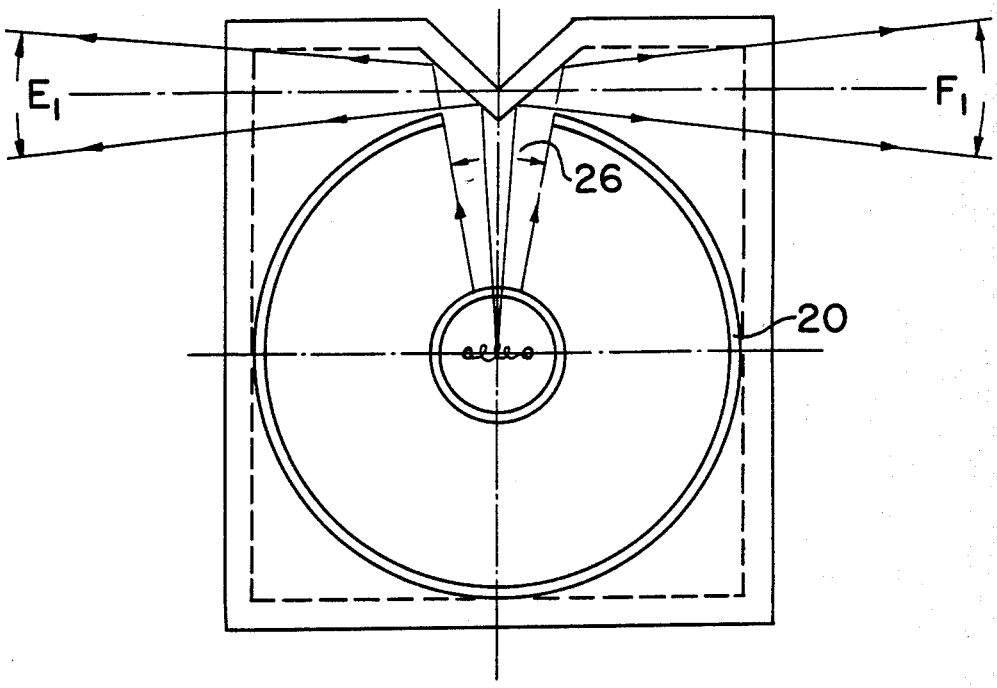
Figure 20:
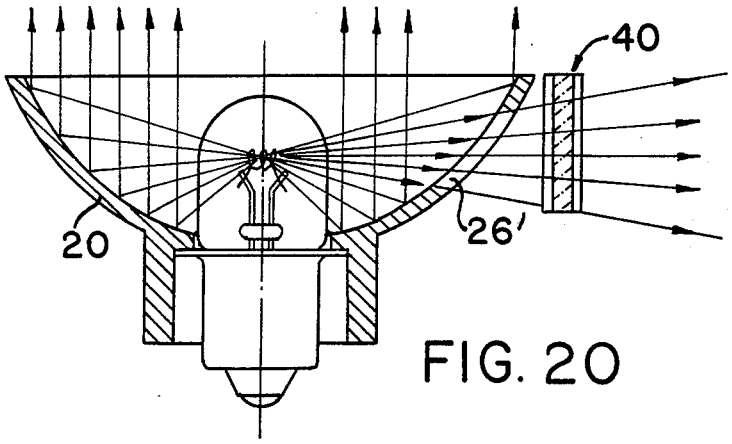
Figure 20A:
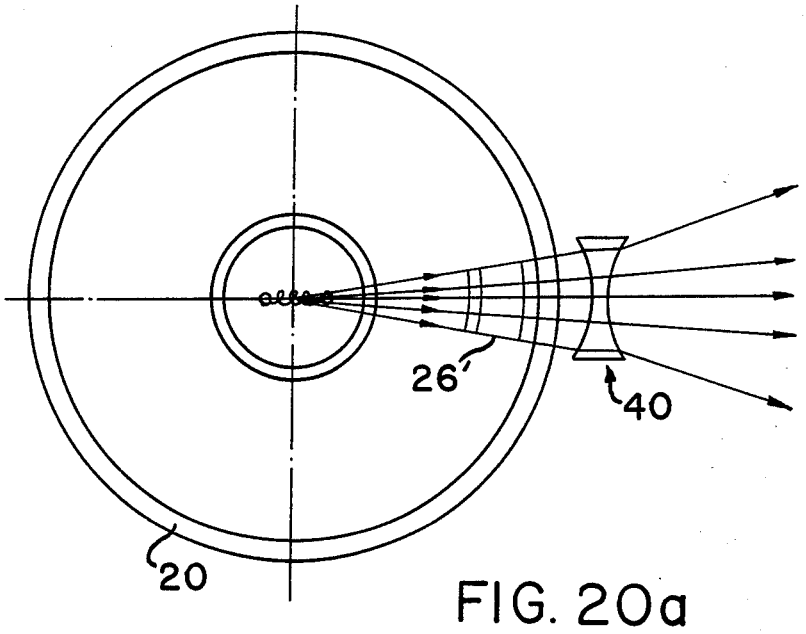
Figure 21:
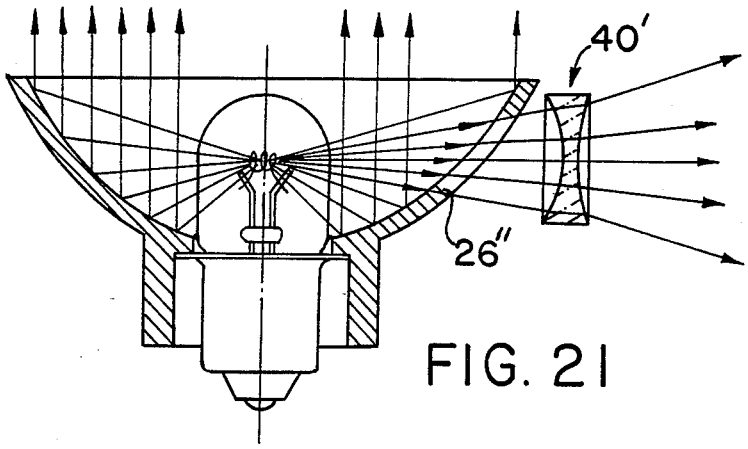
Figure 21A:
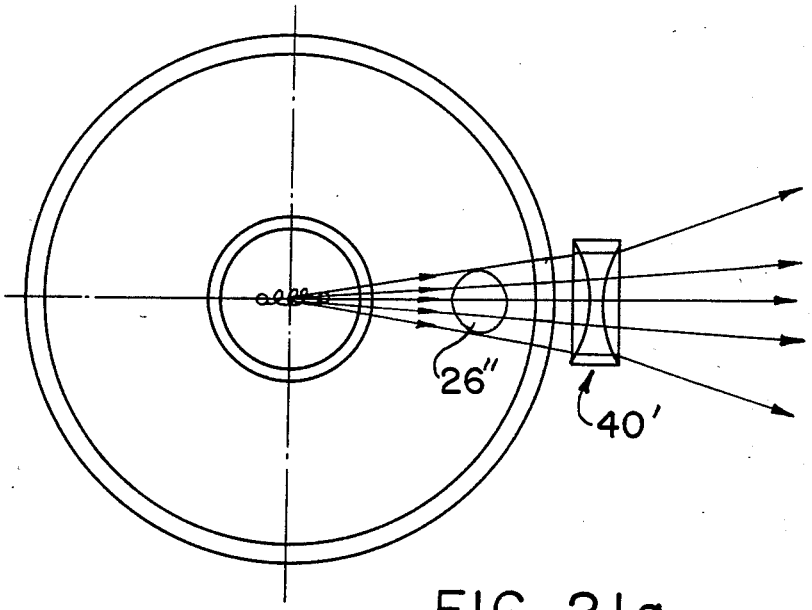

FIGS. 10 and 10*a* are front elevational and longitudinal sectional views, respectively, of one embodiment of a lighting fixture according to the invention having a lateral light outlet aperture which is so large as to eliminate the entire upper half of the concave reflector;

FIGS. 11 and 11*a* are views similar to those of FIGS. 10 and 10*a*, respectively, of another embodiment of the lighting fixture having a lateral light outlet aperture which is so large that a large part of the upper half of the reflector is eliminated;

FIGS. 12 and 12*a* are views similar to those of FIGS. 11*a* and 11, respectively, of a third embodiment of the invention having a lateral light outlet aperture only on one side of the lighting fixture for radiating lateral light acting in horizontal directions;

FIG. 12*b* is an enlarged fragmentary view of FIG. 12*a* affording a clearer understanding of the light radiation path through the lateral light outlet aperture;

FIG. 13 is a view similar to that of FIG. 12*a* of a further embodiment of the invention wherein the lateral light beam can emerge from both sides i.e. the left-hand and right-hand sides, of the lighting fixture after having been collected additionally in direction of the horizontals by a plurality of prisms;

FIG. 13*a* is an enlarged fragmentary sectional view, similar to that of FIG. 12*b*, of the embodiment as shown in FIG. 13 for affording a clearer understanding of the light radiation path;

FIG. 14 is a view similar to that of FIG. 13 of yet a further embodiment of the invention;

FIGS. 15 and 15*a* are views similar to those of FIGS. 12*a* and 12, respectively, of an added embodiment of the lighting fixture which emits lateral light beams to the right-hand and left-hand sides;

FIGS. 16 and 16*a* are views similar to those of FIGS. 15 and 15*a*, respectively, of an additional embodiment of the lighting fixture wherein, however, an additional lateral light outlet aperture is provided for radiation light upwardly, this light being expanded by a dispersion lens to a greater radiation angle;

FIGS. 17, 17*a*, 17*b* and 17*c* are respective longitudinal sectional, cross-sectional, front elevational and top plan views of the concave reflector forming part of the lighting fixture of FIG. 10;

FIGS. 18, 18*a*, 18*b* and 18*c* are respective longitudinal sectional, vertical cross-sectional, front elevational and horizontal cross-sectional views of the concave reflector forming part of the lighting fixture of FIG. 15;

FIG. 19 is a front elevational view of another embodiment of the lighting fixture according to the invention;

FIGS. 20 and 20*a* are respective longitudinal sectional and front elevational views of a further embodiment of the invention which includes an optical system; and FIGS. 21 and 21*a* are views similar to those of FIGS. 20 and 20*a*of yet another embodiment of the invention including an optical system.

Referring now to the drawings and first, particularly, to FIGS. 1 to 3 thereof, there is shown a motor vehicle 2 in a side view in FIG. 1, a rear view in FIG. 2 and a top view in FIG. 3. The motor vehicle 2 has tail lights 4 and 6, each tail light 4, 6 emits a main light beam rearwardly into a rear angular zone $\beta 1$, which is disposed in a vertical plane VK (see FIGS. 20, 21, 22) in which the optical axis 8 of the tail lights 4 and 6 is located. The front parking or position lights 10 and 12 of the motor vehicle 2 emit a main light beam which covers or extends over a front angular zone $\beta 2$ lying in the vertical plane VK in which the optical axis 8 of these lighting fixtures 10 and 12 is disposed. The angular zones $\beta 1$ and $\beta 2$ define the limits or boundaries of the main light beam only in the vertical plane VK; obviously, the main light beam extends over a solid angle, as explained hereinbefore in the introduction hereto.

The optical axes 8 of the main light beams of the lighting fixtures 4, 6, 10 and 12, in the embodiment of FIGS. 1 to 3, are disposed in a respective horizontal plane FF in which the concentration points or centers of the light emitted by the respective luminous bodies of these lighting fixtures are located.

FIG. 2 shows the motor vehicle 2 of FIG. 1 from the rear. A second light radiation or beam zone of each tail light 4 and 6 is shown diagrammatically in FIG. 2 and extends over or covers a lateral aperture angle $\beta 3$ which is disposed in the vertical planes that are perpendicular to the horizontal plane EF and extend through the light center or concentration point of the luminous body of the respective lighting fixture. The size of this lateral aperture angle $\beta 3$ results from the dimensions of a slot formed in the concave reflector and/or a cylindrical collecting lens of the respective lighting fixture in accordance with the invention as will be explained hereinafter in further detail.

FIG. 3 shows the motor vehicle 2 of FIG. 1 in a top plan view. The illustrated arrows indicate the directions of light emanation or emergence, which form a so-called light fan. The light fans of the lighting fixtures 4, 6, 10 and 12 extend in the horizontal plane EF (the plane of drawing of FIG. 3) outwardly over an outer horizontal angle $\gamma 1$ and inwardly over an inner horizontal angle $\gamma 2$. In the embodiment of FIG. 3, the outer horizontal angles $\gamma 1$ or the lighting fixtures 4, 6, 10 and 12 are 110°, respectively, whereas the inner horizontal angles $\gamma 2$ of these lighting fixtures are 50°, respectively.

Figure 4:
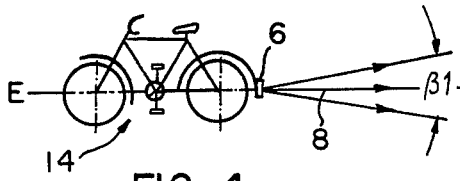
FIGS. 4 to 6 are side, rear elevational and top plan views, respectively, of a bicycle having a tall light disposed thereon in accordance with the invention.
Figure 5:
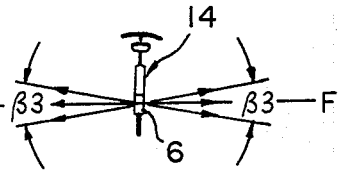
Figure 6:
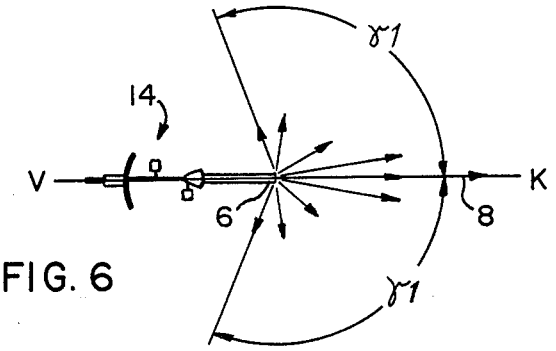
Figure 7:
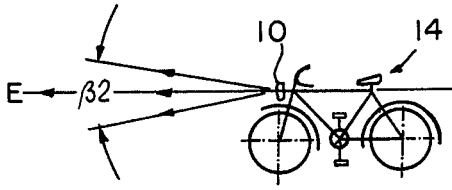
FIGS. 7 to 9 are side, front elevational and top plan views, respectively, of a bicycle having a head lamp disposed thereon in accordance with the invention.
Figure 8:
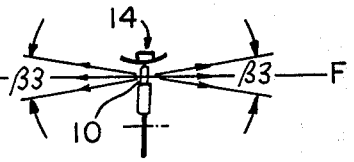
Figure 9:
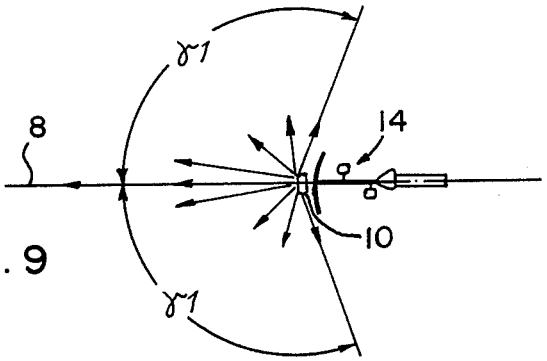

FIGS. 4 to 9 show a bicycle 14 with a rear or tall light 6 and a front position light or a headlamp 10. With regards to the rear angle zone $\beta 1$, the front angle zone $\beta 2$ as well as the lateral aperture angle $\beta 3$, reference is made to the discussion hereinbefore. In contrast to FIG. 3, however, there are shown in FIGS. 6 and 9, two equal outer horizontal angles $\gamma 1$, in the case of a single-track vehicle (a bicycle, motorcycle or the like), the tail light 6 and the front position light or headlamp 10 must exit a wide horizontal light fan to the righthand side and to the lefthand side to be visible to the traffic coming from either side.

The luminous body 18 of the incandescent lamp 16 of the lighting fixture according to the invention shown in FIG. 10 occupies at least part of the focal region of the concave reflector 20. The latter focusses the light rays directly emanating from the luminous body 18 to form a main light beam.

As is apparent from FIG. 10, the additional lateral light outlet opening 26 of the reflector 20 is especially large and encompasses practically the entire upper half of the reflector 20. The main light beam is thus produced only with the aid of the lower half of the reflector 20. Those light rays which impinge laterally and upwardly inclined upon the wall of the transparent housing 32 and, indeed, as viewed from the horizontal plane E-F, upwardly into the corners of the housing 32, are deflected through the light diverting means 30 in horizontal directions. Viewed from the luminous body 18 of the incandescent lamp 16, two angular zones of the radiation, each of 45°, are included , respectively, in the light diverting means 30 such as prisms, for example. These light-diverting means 30 radiate the light in horizontal directions with radiating angles of about 10° above and below a horizontal plane E1-F1. It is apparent therefrom that the light diverting means 30, in addition to the deflecting function thereof, also has a collecting function, in that the light which is captured within a radiating angle of about 45° is radiated further in an emission angle of only 20°. As is apparent from FIG. 10, the lateral light outlet opening 26 of the reflector 20 is so large that the light is radiated transversely and perpendicularly to the axis with a radiating angle y of about 180°. Those light rays which are not captured by the prisms 30 and deflected and concentrated, pass through and emerge from the top of the transparent cover cap 32 and ensure that the tail-light also remains visible for short distances i.e. for distances wherein the upper angular region of the lateral aperture angle $\beta 3$ no longer reaches the eye of a driver approaching from the side. In the case of bicycles, this upper light-radiating region also provides the advantage that the driver can in this manner determine, while he is driving, whether or not the tail-light is still lit.

FIG. 10*a* is a sectional view of FIG. 10 taken along the line E-F in the direction of the arrows. The transparent housing 32 and the reflector 20 are again clearly seen in FIG. 10*a*. The light rays emanating from the luminous body 18 are so deflected in a horizontal plane by the prisms 30 that they illuminate an angular zone of two times $\gamma 1(2X\gamma 1)$ in a supplementation of the normal forward light outlet opening of the reflector. In the case at hand, $\gamma 1$ is greater than 110°. $\gamma 1$ extends from the optical axis 8 of the concave-mirror reflector 20 toward the right-hand and left-hand sides as seen in FIG. 10*a*.

A lighting fixture similar to that of FIGS. 10 and 10*a* is shown in FIGS. 11 and 11*a*. The lateral outlet opening 26 in FIGS. 11 and 11*a* is somewhat smaller, however, than that of FIGS. 10 and 10*a*, so that the light can emerge from above in an angular zone y of about 140°, whereas the reflector 20 altogether encompasses about 220° of the 360°. The main light beam is, in this case, thus stronger i.e. more intense, than that in FIGS. 10 and 10*a*. Also, in the embodiment of FIG. 11, the light rays emerging upwardly and laterally are deflected in horizontal directions by the prisms 30 so that a new horizontal plane E1-F1 is formed, above and below which the light rays are radiated into the angular zone B3. The additional lateral light outlet opening 26 is defined by edges 22 of the reflector 20, as shown in FIG. 11*a*.

Another embodiment of the invention is shown in FIGS. 12 and 12*a*. The reflector 20 has, in this case, been kept nearly completely round except for a small slit-shaped light outlet opening 26. This means that the main light beam is very strong in this embodiment and the light can emerge only from one side laterally from the reflector 20 within an angle y and impinges upon the prisms 30 in order to be deflected thereat into horizontal directions within an angular range $\beta 3$. A new horizontal plane E1-F1 is formed, above which light is emitted within an angular zone $\beta o$ which is at least 10°. Below the horizontal plane E1-F1, light is emitted within an angular zone $\beta u$ which is also somewhat more than 10° in the embodiment of FIG. 12*a*. The lateral slit in the concave mirror reflector 20 is so deep that, as viewed outwardly from the axis 8 of the lighting fixture, light can emerge in horizontal directions within the zone of the angle $\gamma 1$. The angular zone $\gamma 1$ is supplemented by the angular zone $\gamma 2$ i.e. by light which emerges forwardly through the normal opening of the reflector 20. The lighting fixture shown in FIGS. 12 and 12*a* is primarily utilizable for two-track vehicles, such as automobiles, because, in such vehicles, a large light radiating zone $\gamma 1$ must be attained only outwardly.

FIG. 12*b* is an enlarged view of a part of the FIG. 12*a* which affords a better understanding of the travel of the light rays. The reflector 20 is formed with a lateral slit-shaped recess 26 through which the light rays impinge laterally upon the transparent cover cap 32 in the region of the prisms 30 formed thereon. These prisms 30 have been shown exaggeratedly enlarged in FIG. 12*b* so as to be able to demonstrate the path of the light rays. The lower flanks 34 of the prisms 30 lie exactly in direction of the light source i.e. in direction toward the optical axis 8. All light which falls upon the prisms 30 through the light outlet opening 26, is thereby deflected into the angular zone $\beta 3$. If, on the other hand, it is desired not to deflect all of the light, the lower flanks of the prisms 30 can be altered to those presented by the broken lines 36. A small part of the light can thereby emerge upwardly over the angular zone $\gamma o$ in order thereby to ensure visibility of the light at short distances. Obviously, this could also be accomplished by providing short planoparallel sections of the transparent casing cap 32 between the individual prisms 30, through which light can pass in the original direction.

FIGS. 13 and 14 show lighting fixtures according to the invention which radiate lateral light toward both sides i.e. toward the left-hand and the right-hand sides as shown in the figures. The light emerges laterally from the reflector 20 through the light outlet openings 26 which are defined by the edges 22. The prisms 30 divert the light in largely horizontal directions with the vertical radiating angle $\beta 3$.

FIG. 13 is an enlarged fragmentary view of FIG. 13 wherein the light-diverting prisms 30 are again shown in exaggeratedly enlarged form. Also in FIG. 13*a* it is apparent that the lower flanks 34 of the prisms 30 are all directed toward the light source; in this manner all the light or nearly all the light emanating from the light focal point or center in horizontal directions can be deflected or diverted. If this is not desired, however, the lower flanks of the prisms 30 can be changed to those represented by the broken lines 36, in which case, some light then passes upwardly outside the angular zone $\beta 3$. In this case, too, this can be accomplished also by leaving short planoparallel regions of the transparent lighting-fixture casing 32 between the individual prisms 30. The possibility thus exists of extending or expanding the angular zone $\beta 3$ upwardly, as viewed in FIG. 13*a*, for example, and thereby providing such a light distribution that only so much light will always emerge in further lateral directions as to ensure visibility for distances becoming even shorter.

FIGS. 15 and 15*a* likewise show a lighting fixture according to the invention which can radiate a horizontal fan of light toward both sides thereof. This embodiment differs from that of FIG. 13, for example, by having narrower light-outlet openings and correspondingly smaller regions of prisms 30 formed on the transparent casing cap 32.

FIGS. 16 and 16*a* also show a lighting fixture similar to that of FIG. 13 except that, in contrast to FIG. 13, a further lateral light outlet opening 27 is provided at the top thereof, as seen in FIG. 16, through which light can pass upwardly. Above this lateral upwardly directed light outlet opening 27, there is disposed a dispersing optical system 40 which widens or expands the light radiating zone defined within the angular zone E1 by the edges of the light outlet opening 27 into the angular zone E2 and thus provides further visibility upwardly and towards the sides thereof.

FIG. 17 shows in cross section a concave-mirror reflector 20 according to the invention. The reflector 20 terminates at edge 22 threrof i.e. the upper half of the reflector 20 has been omitted altogether and is provided only with sufficient structure to hold the socket for the incandescent lamp 16.

FIG. 17*a* is a cross-sectional view of FIG. 17 taken along the line XI—XI in direction of the arrows. As shown in FIG. 17*a*, light can pass through a lateral light-outlet opening resulting from the termination of the concave-mirror reflector-half 20 at the defining edge 22 upwardly into the angular zone y of about 180°.

FIG. 17*b* is a front end view of the concave-mirror reflector 20 of FIG. 17 terminating at the limiting edge 22 thereof. A lateral light outlet opening is thus formed through which the light can emerge in the angular zone y perpendicularly and transversely to the axis.

FIG. 17*c* is a longitudinal sectional view of FIG. 17*b* taken along line E-F. The defining surfaces of the reflector 20 are shown therein at 22; at these defining surfaces, the lateral large light outlet opening 26 begins. Also shown in FIG. 17*c* is how the light can emerge laterally in an angular zone $\gamma 1$. It follows from FIGS. 17, 17*a*, 17*b* and 17*c* that the light cannot emerge from the reflector 20 below and above a horizontal plane E-F, but rather, that additional light-diverting means must be provided which distribute the light then above and below a new horizontal plane.

Figure 18:
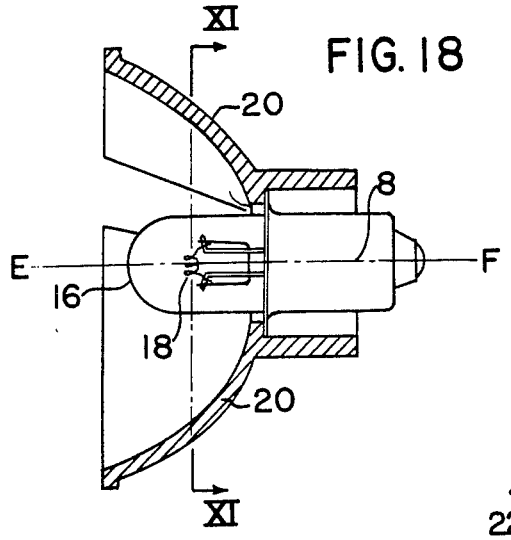
Figure 18A:
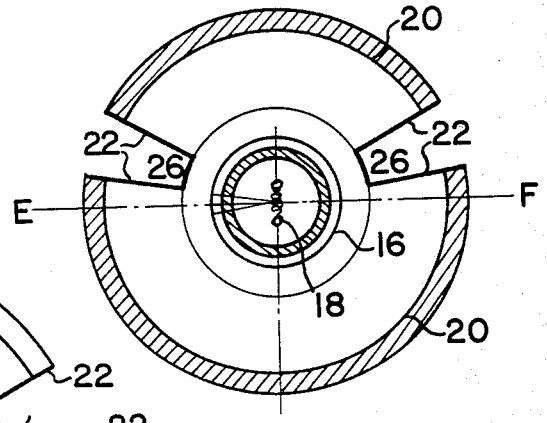

FIG. 18 is a vertical sectional view of the concave-mirror reflector 20 forming part of the lighting fixture of FIG. 15. Clearly shown in FIG. 18 is a slit-shaped additional lateral light outlet opening 26 formed in the reflector 20 above the horizontal plane E-F thereof, the opening 26 being defined above and below by the edge 22 of the reflector 20.

FIG. 18 *a* is a cross-sectional view of FIG. 18 taken along the line XI—XI in direction of the arrows. Clearly shown therein are the lateral slit-shaped additional light outlet openings 26.

Figure 18B:
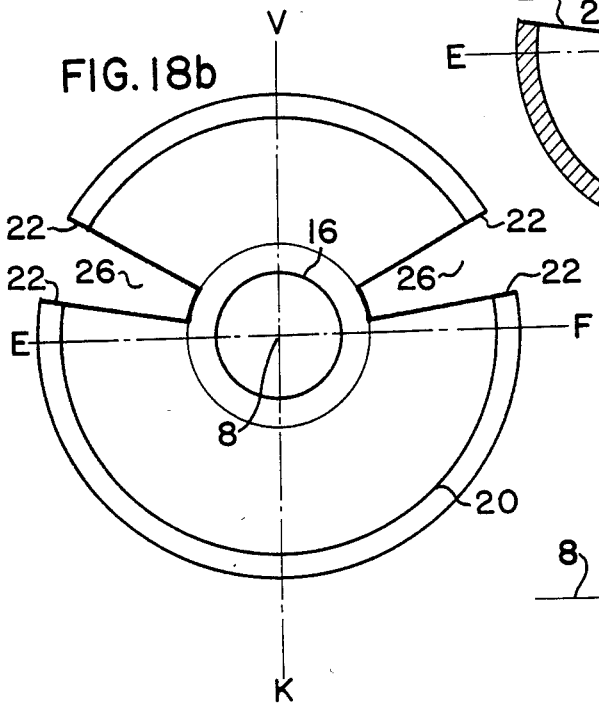

FIG. 18*b* is a front end view of the concave reflector 20 of FIG. 18. Also in this figure there is readily seen the slit-shaped conically widening, additional lateral light outlet openings 26. They are so formed that, as viewed from the light center 8, the opening angle of respective pairs of points located opposite one another on the edges 22 defining the respective light outlet openings 26 are always substantially equal.

Figure 18C:
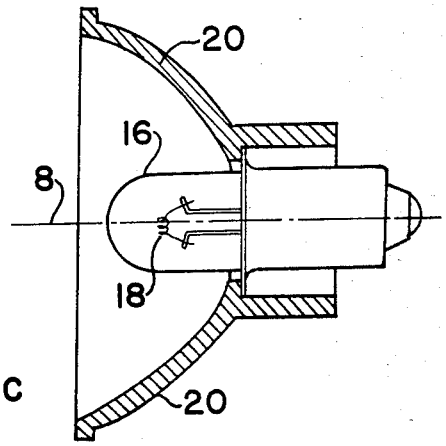

FIG. 18*c* is a longitudinal sectional view of FIG. 18*b* taken along the line V-K and further shows the structure of the reflector 20.

FIG. 19 is a front end view of yet another embodiment of the lighting fixture according to the invention wherein the reflector is formed with an upwardly directed light outlet opening or aperture 26. The transparent casing cap 32 is formed with a reflecting chevron or arrowhead-shaped portion located above the opening 26 for reflecting the light rays in horizontal or substantially horizontal directions.

When applying the invention to automobile headlamps, it was found that a lateral slit-shaped opening or aperture in the headlamp would permit light of too great intensity to emerge laterally, causing glare at the sides.

It was found that such glare could be avoided by employing the embodiments of the invention shown in FIGS. 20, 20*a* and 21, 21*a*.

FIG. 20 is a longitudinal sectional view of FIG. 20*a* which is a front end view of an embodiment of the invention which also includes an additional optical system 40 which enlarges the angle of light passing through a lateral opening 26' formed in the concave reflector 20 instead of collecting the light. The slots 26' can consequently be made suitably narrow, and more light can be reflected by the concave reflector into the main light beam.

FIG. 21 is a longitudinal sectional view of another embodiment of the invention wherein a small circular hole 26'' is formed laterally in the concave reflector and, in order to increase the aperture angle all around, an axially symmetric concave dispersion lens 40' is provided as the additional optical system. FIG. 21*a* is a front end view of FIG. 21.

Of course, very many additional combinations and structural modifications of the invention are possible within the scope thereof. For example, in the embodiment of FIG. 10, the concave reflector can also be disposed in the upper half of the casing 32, and the additional light outlet opening toward the bottom thereof without going beyond the basic concept of the invention.

There are claimed:

1. Lighting fixture comprising an enclosure, means disposed in said enclosure, for supplying a central source of light therein, a concave, generally parabolic reflector for directing a main beam of light out of said enclosure from said source generally along a given optical axis, said central source of light being located at the focal region of said concave reflector, said concave reflector having a light penetrable region thereof disposed at least at one side of said optical axis in a horizontal plane in common with said central light source, said light penetrable region forming an escape window out of said enclosure for part of the light from said source, said means for supplying said central source of light comprising a luminous body, and including a collecting lens disposed in front of said luminous body and an optical system in front of said collecting lens for scatterling light in only two opposing directions in said horizontal plane.

2. Lighting fixture according to claim 1 wherein said light-scattering optical system comprises a concave cylindrical lens.

3. Lighting fixture according to claim 2 wherein said enclosure has a cover plate, and said concave cylindrical lens is an integral part of said cover plate.

4. Lighting fixture comprising an enclosure, means disposed in said enclosure for supplying a central source of light therein, a concave, generally parabolic reflector for directing a main beam of light out of said enclosure from said source generally along a given optical axis, said central source of light being located at the focal region of said sonsave reflector, said concave reflector having a light penetrable region thereof disposed at least at one side of said optical axis in a horizontal plane in common with said central light source, said light penetrable region forming an escape window out of said enclosure for part of the light from said source, said concave reflector having a base at one end thereof and a light outlet at the other end thereof, said light penetrable region being in the form of a slot extending from a region close to said base to said light outlet, said means for supplying a central light source comprising a luminous body, and including an optical collecting system disposed in a light path extending from said luminous body and through said slot, said optical collecting system comprising a cylindrical collecting lens disposed in said horizontal plane, said cylindrical collecting lens being disposed in said horizontal plane at one side of said optical axis, and another cylindrical collecting lens being disposed in said horizontal plane at an opposite side of said optical axis from said first-mentioned cylindrical collecting lens, both of said cylindrical collecting lenses being elongated and mutually joined in front of said luminous body into one continuous lens member extending over areas which are at best only slightly irradiated by said main light beam.

5. Lighting fixture comprising an enclosure, means disposed in said enclosure for supplying a central source of light therein, a concave, generally parabolic reflector for directing a main beam of light out of said enclosure from said source generally along a given optical axis, said central source of light being located at the focal region of said concave reflector, said concave reflector having a light penetrable region thereof disposed at least at one side of said optical axis in a horizontal plane in common with said central light source, said light penetrable region forming an escape window out of said enclosure for part of the light from said source, said light penetrable region comprising at least one aperture formed in said concave reflector, said aperture being formed as a slot in said concave reflector on only one side of said optical axis in said horizontal plane, and including a spherical reflector extending over an annular region and disposed between said central light source and said concave reflector on the other side of said optical axis and opposite said slot whereby part of the light radiated directly from said light center and impinging on said spherical reflector is, in turn radiated therefrom through said slot.

6. Lighting fixture according to claim 5 wherein said spherical reflector is of multistep construction.

7. Lighting fixture according to claim 5 wherein said aperture is formed as a slot in said concave reflector on only one side of said optical axis in said horizontal plane, and including a spherical reflector extending over an annular region and disposed between said central light source and said concave reflector on the other side of said optical axis and opposite said slot whereby part of the light radiated directly from said light center and impinging on said spherical reflector is, in turn radiated therefrom through said slot, said spherical reflector being disposed in a region of said concave reflector.

8. Lighting fixture comprising an enclosure, means disposed in said enclosure for supplying a central source of light therein, concave, generally parabolic reflector for directing a main beam of light out of said enclosure from said source generally along a given optical axis, said central source of light being located at the focal region of said concave reflector, said soncave reflector having a light penetrable region thereof disposed at least at one side of said optical axis in a horizontal plane in common with said central light source, said light penetrable region forming an escape window out of said enclosure for part of the light from said source, said light penetrable region comprising at least one aperture formed in said concave reflector, and a second lighting fixture combined therewith into a structural unit, said second lighting fixture having a concave reflector located at least nearly beyond the concave reflector of the first-mentioned lighting fixture, said second lighting fixture having an optical axis disposed at an angle of between 2° to 6° to the optical axis of said first-mentioned lighting fixture, said optical axis of said first-mentioned lighting fixture, in installed condition of the lighting fixture assembly, being disposed in said horizontal plane, both of said lighting fixtures having respective incandescent lamps as said means for supplying a light source, the incandescent lamp of said first-mentioned lighting fixture having a smaller current drain than that of said second lighting fixture and serving as a position light, the incandescent lamp of said second lighting fixture having said optical axis thereof declining from said horizontal plane in said installed condition of the lighting fixture assembly and serving for illumination.

9. Lighting fixture assembly according to claim 8 including a common housing for both of said lighting fixtures, and a spirit level mounted on said common housing.

10. Lighting fixture assembly according to claim 8 including means connectible to a battery for energizing said first-mentioned lighting fixture with battery current, and means selectively connectible to a battery and to a mechanical generator for energizing said second lighting fixture.

11. Lighting fixture with a concave reflector having a main beam outlet and an additional lateral light outlet aperture on one side of the optical axis thereof so that light rays directly emanating from a luminous body are partly collected by the concave reflector into a main light beam reflected through the main beam outlet aperture, the lateral light outlet aperture being disposed nearly outside a horizontal plane in common with the light center of the luminous body comprising light-conducting means disposed in the light path through the lateral light outlet aperture for deflecting in substantially horizontal directions at least part of the light rays passing laterally out of the concave reflector, said substantially horizontal directions being substantially perpendicular to the axis of the concave reflector, the lateral light outlet aperture extending from one side of a horizontal plane extending through the luminous body to the opposite side thereof, the lateral light outlet aperture extending over an angle smaller than 180° perpendicularly to the axis of the concave reflector, the lateral light outlet aperture, at least on one side of the concave reflector extending from a region located in vicinity of a horizontal plane extending through the luminous body over a first angular zone of more than 20°, and said light-conductive means disposed in the light path through the lateral light outlet aperture serve not only for deflecting the light rays in substantially horizontal direction but also for collecting the light rays in a second angular zone, said second angular zone having a smaller aperture angle than that of said first angular zone.

* * * * *